United States Patent [19]

Steffens et al.

[11] Patent Number: 4,983,107

[45] Date of Patent: Jan. 8, 1991

[54] MULTISTAGE ROTARY PISTON VACUUM PUMP HAVING SLEEVES TO FIX SHAFT POSITIONS

[75] Inventors: Ralf Steffens; Hans-Peter Kabelitz; Hanns-Peter Berges, all of Cologne; Wolfgang Leier, Bergisch Gladbach, all of Fed. Rep. of Germany

[73] Assignee: Leybold Aktiengesellschaft, Cologne, Fed. Rep. of Germany

[21] Appl. No.: 192,559

[22] Filed: May 11, 1988

[30] Foreign Application Priority Data

May 15, 1987 [EP] European Pat. Off. ..... 87107090.0

[51] Int. Cl.[5] ..... F04C 25/02; F04C 29/04

[52] U.S. Cl. ..... 418/9; 418/83; 418/84; 418/94; 418/152; 418/179; 418/206

[58] Field of Search ..... 418/206, 9, 83, 85, 418/87, 84, 88, 94, 179, 152, 10

[56] References Cited

U.S. PATENT DOCUMENTS

| | | | |
|---|---|---|---|
| 901,539 | 10/1908 | Leyner | 418/94 |
| 1,653,814 | 12/1927 | Mild | 418/85 |
| 2,014,932 | 9/1935 | Hallet | 418/179 X |
| 2,367,463 | 1/1945 | Heimbach | 418/206 X |
| 2,708,548 | 5/1955 | Blanton | 418/179 |
| 2,938,664 | 5/1960 | Noller | 418/85 |
| 3,150,593 | 9/1964 | Funk et al. | 417/252 |
| 3,237,276 | 3/1966 | Ernst von der Ohe | 29/121 |
| 4,035,112 | 7/1977 | Hackbarth et al. | 418/83 X |
| 4,226,574 | 10/1980 | Villette | 417/420 |
| 4,504,201 | 3/1985 | Wycliffe | 418/9 X |
| 4,648,817 | 3/1987 | Mariani | 418/206 X |
| 4,779,578 | 10/1988 | Eiermann | 418/83 X |

FOREIGN PATENT DOCUMENTS

| | | |
|---|---|---|
| 758120 | 10/1953 | Fed. Rep. of Germany . |
| 2007880 | 9/1971 | Fed. Rep. of Germany . |
| 3124247 | 6/1983 | Fed. Rep. of Germany . |
| 365821 | 1/1963 | Switzerland . |
| 525761 | 9/1940 | United Kingdom . |
| 529059 | 11/1940 | United Kingdom . |
| 2141486 | 12/1984 | United Kingdom . |

OTHER PUBLICATIONS von Gunter Leuschner, "Kleines Pumpenhandbuch fur Chemie und Technik", [Small Pump Manual for Chemistry and Technology], published by Verlag Chemie GmbH 1967, pp. 226–231.

*Primary Examiner*—John J. Vrablik

*Attorney, Agent, or Firm*—Spencer & Frank

[57] ABSTRACT

A twin-shaft vacuum pump includes a pump chamber, a pair of rotary pistons disposed in the pump chamber, and plates which laterally delimit the pump chamber, and a housing ring which peripherally delimits the pump chamber. In order to increase the ability of the pump to withstand thermal stresses, the housing ring and the rotary pistons are made of different materials, with the coefficient of expansion of the piston material being lower than the coefficient of expansion of the housing material. Other improvements include cooling of the lateral end plates, cooling of the rotors, and the provision of sleeves which serve to fix the position of the rotors on the shafts and which are composed of a material whose coefficient of expansion is lower than that of the rotor material.

15 Claims, 2 Drawing Sheets

MULTISTAGE ROTARY PISTON VACUUM PUMP HAVING SLEEVES TO FIX SHAFT POSITIONS

BACKGROUND OF THE INVENTION

The present invention relates to a twin-shaft vacuum pump including a pump chamber, a pair of rotary pistons disposed in the pump chamber and end plates laterally delimiting the pump chamber as well as a housing ring which peripherally delimits the pump chamber.

Twin-shaft pumps include, for example, Roots pumps whose rotary pistons have an approximately figure-eight shaped cross section, Northey pumps with claw-shaped rotors, screw pumps and the like. The pairs of rotary pumps rotate without contact relative to one another and to the pump chamber walls and cause the pumping medium to be conveyed from the inlet to the outlet of the pump. These twin-shaft pumps are particularly suitable for use as vacuum pumps since no sealing and cooling means are required in the pump chamber and there thus exists no danger of contamination from the sealing agent.

Due to the contact-free arrangement of the rotary piston in the housing, it is unavoidable that some of the conveyed medium flows back. The volumetric efficiency of twin-shaft pumps of this type is therefore defined by the ratio of the effective quantity of gas conveyed to the theoretically conveyable quantity of gas. The less play there is between the individual rotary pistons and between the rotary pistons and the pump chamber walls, the less return flow occurs, that is, the better is the volumetric efficiency of the pump. However, the selection of any desired small amount of play is not possible for thermal reasons. During operation, the pump heats up. The possible range of existing plays is therefore reduced so that there exists the danger of the rotary pistons scraping against the housing. If the rotational speed is increased, as is desirable in order to reduce the overall structural volume of the vacuum pump, these difficulties increase because of the resultant increased power density.

Regarding the housing, there exists the possibility of dissipating the heat by means of a water or air cooling system. However, the dissipation of heat from the rotating, rotary pistons is essentially effected only by the conveyed medium itself which either transfers the heat from the rotary piston to the housing or carries the heat along with it. Since operation of twin-shaft pumps in a vacuum makes available only relatively few molecules to carry away the heat, the thermal problems in this field are particularly critical.

SUMMARY OF THE INVENTION

It is an object of the present invention to provide a vacuum pump of the above-mentioned type in which the disadvantageous effects of thermal expansion are reduced.

The above and other objects are accomplished according to the invention by the provision of a twin-shaft vacuum pump including:

(a) a pump chamber, (b) a pair of rotary pistons disposed in the pump chamber, (c) end plates which laterally delimit the pump chamber, (d) a housing ring which peripherally delimits the pump chamber, (e) the housing ring and the rotary pistons being composed of different materials, the coefficient of expansion of the piston material being lower than the coefficient of expansion of the housing material.

This is accomplished according to the present invention in that the housing ring and the rotary pistons (rotors) are made of different materials and the coefficient of expansion of the rotor material is lower than the coefficient of expansion of the housing material. If, for example, the rotors are made of gray cast iron or ceramic and the associated housing ring is made of aluminum, the housing is able to follow the expansion of the more intensely heated rotors despite heating less quickly, since aluminum has a significantly higher coefficient of expansion than gray cast iron or ceramic. If a rotor is made of ceramic it may even be necessary, due to the very low coefficient of expansion of ceramic, to cool the housing in order to prevent the play between the rotor and the housing from increasing if the pistons are heated considerably and the housing is heated to a somewhat lesser degree.

If the pump is equipped with rotors of the claw type, it is sufficient for the claws of these rotors to be made, for example, of ceramic in order to delay, as the temperature increases, the exhaustion of the radial play or to prevent such exhaustion from occurring. A rotor of this type can be manufactured more economically than a rotor made completely of ceramic.

To improve the thermal behavior of the pump it is additionally advisable to arrange sleeves on the shafts to fix the position of the rotors, with such sleeves being made of a material whose coefficient of expansion is lower than the coefficient of expansion of the rotor material. This measure is of particular advantage in connection with multi-stage pumps.

A further advantageous measure resides in cooling the outer end plates but not the housing ring or rings and the intermediate plates provided in multi-stage pumps. This keeps the bearing temperature low and somewhat reduces the rotor temperature while the housing temperature takes on higher values. The housing is thus enabled to expand sufficiently to keep up with the expansion movement of the more intensely heated rotors. This is particularly applicable if the pump housing is encapsulated, in which case the heat dissipation is reduced further.

The temperature of the rotors can be reduced further if the rotors are equipped with a cooling system.

The invention will be described in greater detail below with reference to embodiments which are illustrated in the drawings.

DETAILED DESCRIPTION OF THE PREFERRED EMBODIMENTS

Figure 1:
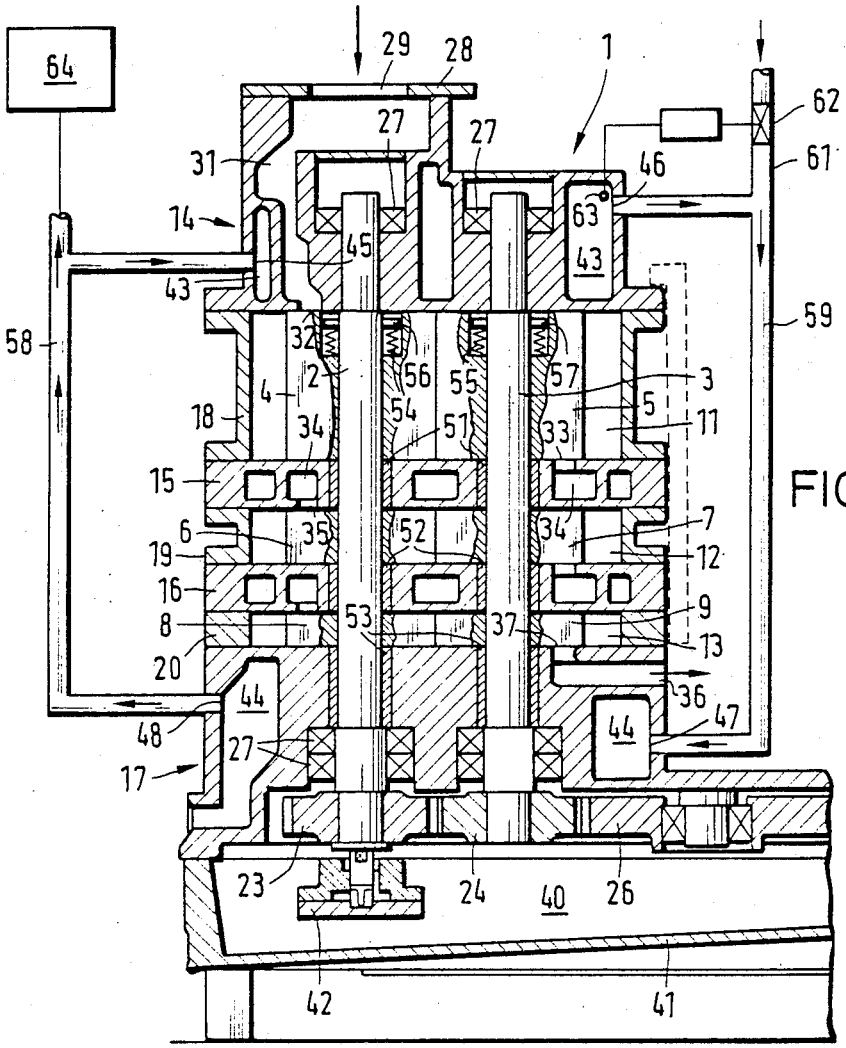
FIG. 1 is a longitudinal sectional view of a three-stage twin-shaft vacuum pump according to the invention.
Figure 2:
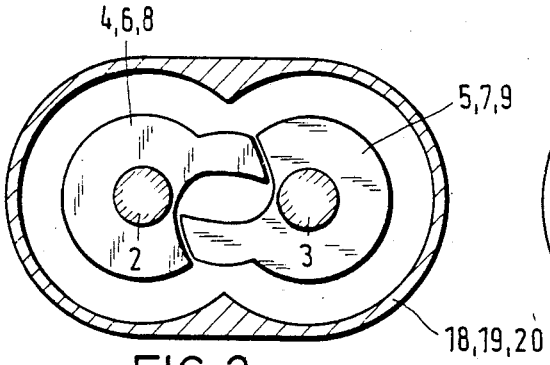
FIG. 2 is an end view, partially in section, of a rotor pair.

The embodiment shown in FIG. 1 includes a three-stage vacuum pump 1 having two shafts 2 and 3 and three rotor pairs 4 and 5, 6 and 7, as well as 8 and 9. The axial length of the rotors decreases from the suction side to the pressure side. The rotary pistons are of the claw type (see FIG. 2) and rotate in pump chambers 11, 12 and 13 which are formed by plates 14 to 17 and housing rings 18 to 20.

Shafts 2 and 3 are arranged vertically. This also applies for a drive motor (not shown) which can be arranged next to the pump housing. Below the lower end plate 17, shafts 2 and 3 are equipped with gears 23 and 24, both having the same diameter and serving to synchronize the movement of rotor pairs 4 and 5, 6 and 7, as well as 8 and 9. The drive motor is also provided with a gear at its underside. The driving connection is established by a further gear 26 which meshes with the gear of the drive motor and with gear 24 of the synchronization mechanism.

Shafts 2 and 3 are supported by way of roller bearings 27 in the upper end plate 14 and in the lower end plate 17. The upper end plate 14 is equipped with a horizontally disposed connecting flange 28 which forms the inlet 29 for the pump. An inlet channel 31 opens at a frontal face of the pump chamber 11 of the first stage via an opening 32. The outlet opening at the frontal face of the first stage is marked with the numeral 33 and leads into a connecting channel 34. The connecting channel 34 in the plate 15 is in communication with an inlet opening 35 of the second stage. The end plate 16 is configured correspondingly. Below the third and lowermost pump stage, there is disposed an outlet 36 which is in communication with a frontal outlet opening 37 in the lower end plate 17.

Below the system composed of the pump housing and motor, there is provided a chamber 40 containing oil. The chamber 40 is formed by a common shaft trough 41. An oil pump 42 connected with shaft 2 projects into the shaft trough 41. Lubricant channels (not shown) extend from the oil pump to the parts of the pump (bearings, locations where gears 23 to 26 mesh, shaft seals or the like) which require lubrication.

The illustrated embodiment of a three-stage twin-shaft vacuum pump is water cooled. For this purpose, cooling water channels 43 and 44 are provided in the lateral end plates 14 and 17. The cooling water inlet and outlet are respectively marked with the numerals 45 and 46 (upper plate 14) and 47 and 48 (lower plate 17). A cooling waster outlet 49 (shown in FIG. 4) is disposed at the lowermost point of channel system 44 so that, for drainage of the cooling system, simple cooling water discharge is possible and complete emptying of the system is ensured.

The rotors 4 to 9 are disposed on respective shafts 2 and 3 and held thereon in such a manner that their positions remain uninfluenced by longitudinal play of the shafts. A transfer of torque must here be possible without relative rotational play between the rotor and its supporting shaft. The upper bearings 27 are roller or needle bearings which permit longitudinal play of the shafts upon expansion.

Figure 4:
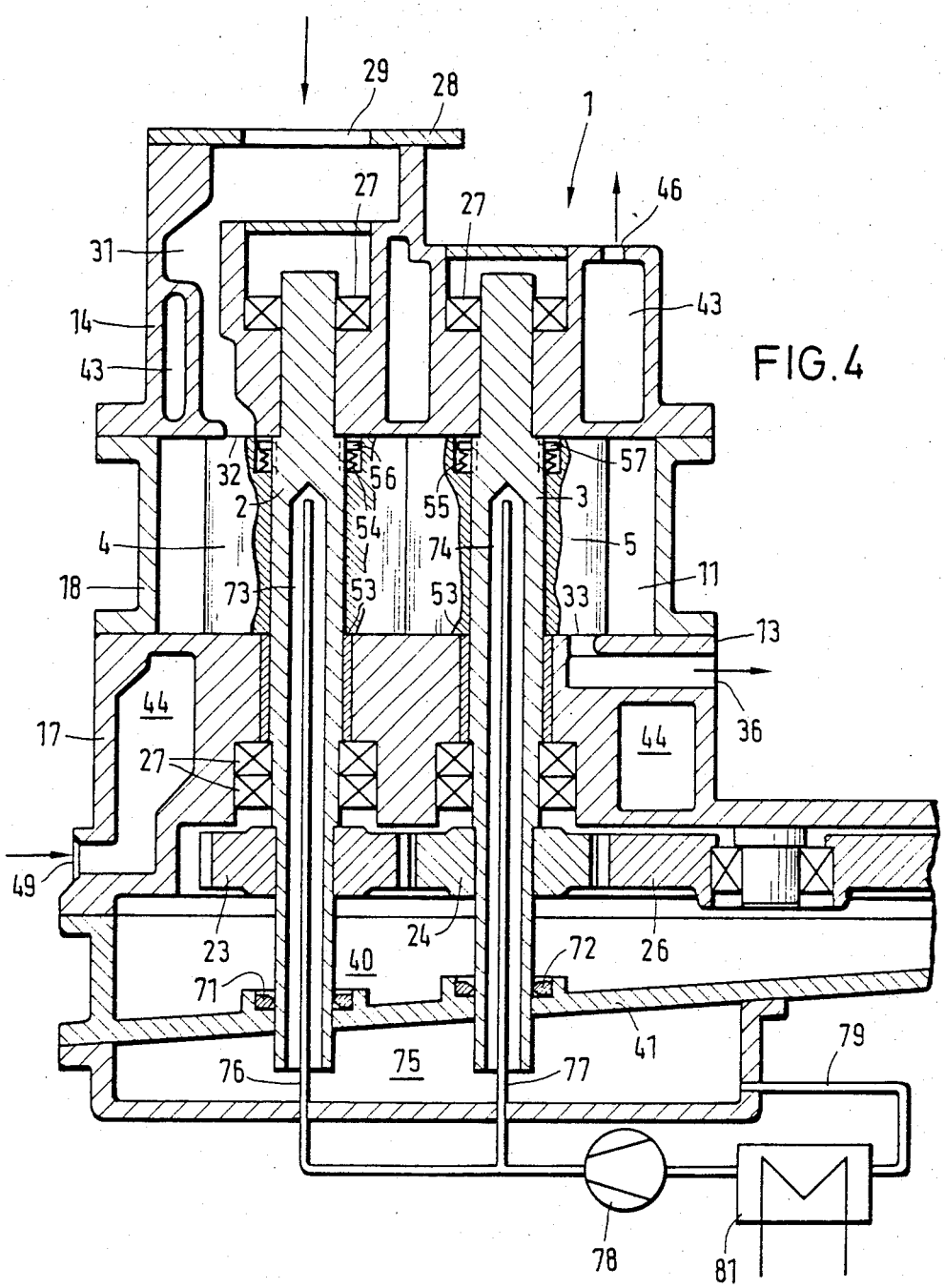
FIG. 4 is a longitudinal sectional view of a single-stage twin-shaft vacuum pump with cooled rotor.

To ensure the correct positions of the rotors 4 to 9 on respective shafts 2 and 3, pairs of sleeves 51 to 53 are provided which are disposed at the height of the intermediate end plates 15 and 16 and in the lower end plate 17. The units composed of the sleeves 51 to 53 and the rotors 4 to are resiliently clamped onto the shafts 2 and 3 by means of cup springs 54 and 55 and nuts 56 and 57, as schematically represented in FIGS. 1 and 4.

The sleeves are made of steel or ceramic, a material which has a lower coefficient of expansion than the rotors which are made, for example, of gray cast iron.

With respect to the described expansions, expansion in the axial direction is meant. If the sleeves 51 to 53 were to have the same thermal coefficient of expansion as the housing or housing rings 18 to 20, they would expand in the axial direction more than would the housing rings 18 to 20 since the sleeves 51 to 53 become relatively hot during operation, while the housing rings 18 to 20 remain relatively cool. As a result, the lower sleeves 53, extending between a stop (on their lower side) and the lower side of the rotors 8 and 9, would raise the rotors 8 and 9 with respect to the housing rings 18 to 20. This would consequently raise sleeves 51 and 52 as well as the rotors 4 to 7. Furthermore, the expansion of the sleeves 51 and 52 would additionally be proportionately greater than that of the housing or housing rings 18 to 20, which remain relatively cool. Therefore, these expansion movements have their largest effect in the region of the first stage (the highest stage) of the pump 1. The provision of sleeves 51 to 53 which have relatively lower thermal coefficients of expansion than that of the housing or housing rings 18 to 20 therefore reduce or eliminate the effects of thermal expansion.

If a rotor system of this configuration heats up, sleeves 51 to 53, which expand less than the rotors 4 to 9, completely or partially compensate any displacement of the rotary pistons relative to the housing, which would have a particularly strong effect in the region of the first stage. If, additionally, housing rings 18 to 20 are made of aluminum, the housing will expand more in spite of being heated relatively slightly, so that it will be able to follow the expansion movements of the rotary pistons. As a whole, pumps according to the present invention are able to withstand much higher thermal stresses and thus permit an increase in the operating rotational speed and/or operation with greater pressure differences between the vacuum pump inlet and outlet.

The thermal reliability in operation is further improved if the lateral end plates 14 and 17 are cooled, but not the housing rings 18 to 20 or the intermediate end plates 15 and 16. Effective thermal expansion of the housing and the intermediate end plates with respect to the rotors is realized in this way. Bearing temperatures can thereby be held low. Moreover, to a slight extent this cools the rotary pistons.

In the embodiment shown in FIG. 1, which has vertical shafts 2 and 3, the medium flows essentially horizontally through lateral end plates 14 and 17. By means of two connecting conduits 58 and 59, the cooling water outlet 46 of the upper end plate 14 is connected with the cooling water inlet 47 of the lower end plate 17 and the outlet 48 of the lower end plate 17 is connected with the inlet 45 of the upper end plate 14, thus forming a closed cooling circuit in which the cooling medium circulates merely by convection. This convection flow is reinforced if cooling water inlets 45 and 47 lie lower than the respective cooling water outlets 46 and 48.

In the region of upper cooling water outlet 46, a fresh water supply conduit 61 equipped with a valve 62 is connected to conduit 59. The valve opens if the temperature of the cooling medium exceeds a fixed value (measuring location 63). The supplied cold cooling medium is initially mixed with the existing warm cooling medium so that the pump is not stressed by a cold shock. In the region of the upper cooling water inlet 45, a vessel 64 is connected to conduit 58 to receive excess cooling water and serve as an expansion vessel.

Figure 3:
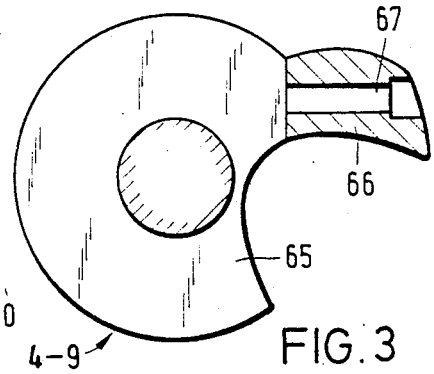
FIG. 3 is an end view, partially in section, of a claw-type rotor having a claw made of ceramic.

FIG. 3 shows a representative rotor end view corresponding to that of rotors 4 to 9, of the claw type, with the claw portion being shown in section. A central section 65 and a claw 66 are separate components each having a planar face. The two components are screwed together (screws 67) in such a way that the planar faces lie against one another. The central body 65 is composed, for example, of gray cast iron while claw 66 is made of ceramic. If a rotary piston of this type is heated, there is less radial expansion.

FIG. 4 shows a single-stage, likewise vertically arranged twin-shaft vacuum pump 1. Corresponding parts of the embodiments according to FIGS. 1 and 4 are given the same reference numerals. To reduce too intensive heating and thus expansion of the rotary pistons 4 and 5, these rotary pistons are equipped with a cooling system. For this purpose, the shafts 2 and 3 extend downwardly and pass through the oil chamber 40 and an oil pan 41. The shafts 2 and 3 are sealed in the oil pan 41 by means of radial shaft sealing rings 71 and 72.

The shafts 2 and 3 are each provided with blind bores 73 and 74, respectively, which are open at the bottom. The lower ends of the shafts 2 and 3 project into a coolant container 75 disposed below the oil chamber 40. Coolant supply conduits 76 and 77 extend from the bottom into the blind bores 73 and 74, respectively. The open ends of the coolant conduits 76 and 77 extend approximately to the center of the rotors 4 and 5. The coolant supply conduits 76 and 77 are in communication with a booster pump 78 whose inlet side is in communication with the coolant container 75 by way of a conduit 79. A heat exchanger 81 is preferably included in conduit 79 in order to ensure a sufficiently low temperature for the coolant.

During operation, the coolant is sprayed into the blind bores 73 and 74 and, due to gravity, flows back into the coolant container 75. From there it travels through the conduit 79 and the heat exchanger 81, and back to the booster pump 78.

Water is the most expedient coolant. Oil or compressed air can also be employed. If oil is employed which simultaneously serves to lubricate the bearings and/or gears, the separate oil and coolant containers 40 and 75 are not required so that the sealing rings 71 and 72 can also be omitted.

It will be understood that the above description of the present invention is susceptible to various modifications, changes and adaptations, and the same are intended to be comprehended within the meaning and range of equivalents of the appended claims.

What is claimed is:

1. A multi-stage twin-shaft vacuum pump, comprising:

(a) a multi-stage pump chamber, (b) a pair of generally vertically disposed shafts and a pair of rotary pistons disposed in each stage of said multi-stage pump chamber, each said pair of rotary pistons being supported by a respective one of said shafts, each said shaft having a sleeve thereon to fix the position of the respective said shaft in said multi-stage pump chamber, each said sleeve being composed of a material having a coefficient of expansion which is lower than that of the material forming said rotary pistons, (c) upper and lower end plates which laterally delimit said pump chamber, and intermediate end plates, said sleeves surrounding the respective said shafts at the level of said intermediate end plates and at the level of said lower end plate, (d) a housing ring which peripherally delimits said pump chamber, (e) said housing ring and said rotary pistons being composed of different materials, the coefficient of expansion of the piston material being lower than the coefficient of expansion of the housing material.

2. A pump as defined in claim 1, wherein said pistons are composed of gray cast iron.

3. A pump as defined in claim 1, wherein said pistons are composed of ceramic material.

4. A pump as defined in claim 2, wherein said housing ring is composed of aluminum.

5. A twin-shaft vacuum pump as claimed in claim 1, wherein:

said pair of rotary pistons are of the claw type and said claws of said pair of rotary pistons are composed of a material having a relatively low coefficient of expansion.

6. A pump as defined in claim 5, wherein said claws are fastened by a fastening means to a central body portion of said rotary pistons.

7. A pump as defined in claim 1, wherein each of said sleeves is composed of steel.

8. A pump as defined in claim 1, wherein each of said sleeves is composed of ceramic material.

9. A pump as defined in claim 1, wherein said rotors are fixed in their positions by spring means.

10. A pump as defined in claim 1, wherein said end plates include a fluid cooling system.

11. A pump as defined in claim 10, wherein a cooling medium flows through said end plates in a direction which is essentially perpendicular to the axis of rotation of said rotary pistons, and said cooling system communicates with said end plates via two external connection conduits, differences in temperature causing the cooling medium to circulate due to convection.

12. A pump as defined in claim 11, wherein said cooling medium is water, and further comprising cooling water outlets respectively disposed in each of said end plates, and cooling water inlets respectively disposed in each of said end plates, said cooling water inlets being disposed at a lower position than respective ones of said cooling water outlets of each of said end plates.

13. A pump as defined in claim 12, wherein an expansion vessel is disposed in the region of an upper one of said cooling water inlets, said expansion vessel simultaneously serving to receive warm cooling water during the intake of fresh water.

14. A pump as defined in claim 11, wherein said cooling medium is water, and wherein a fresh water supply is connected near an uppermost one of said cooling water outlets.

15. A pump as defined in claim 14, further comprising a valve disposed in a conduit communicating with said fresh water supply conduit, said valve being actuated as a function of the temperature of said cooling medium in said cooling system.

* * * * *

UNITED STATES PATENT AND TRADEMARK OFFICE

CERTIFICATE OF CORRECTION

PATENT NO. : 4,983,107

DATED : January 8th, 1991

INVENTOR(S) : Ralf Steffens; Hans-Peter Kabelitz; Hanns-Peter Berges; Wolfgang Leier, Hartmut Kriehn It is certified that error appears in the above-identified patent and that said Letters Patent is hereby corrected as shown below:

Title Page

In the heading of the patent under [75]:

After "Gladbach," please insert --Hartmut Kriehn, Cologne,--.

Signed and Sealed this

Twenty-fifth Day of August, 1992

*Attest:*

DOUGLAS B. COMER

*Attesting Officer*

*Acting Commissioner of Patents and Trademarks*